US006963320B2

(12) United States Patent
Kanazawa

(10) Patent No.: US 6,963,320 B2
(45) Date of Patent: Nov. 8, 2005

(54) DRIVING METHOD AND PLASMA DISPLAY APPARATUS OF PLASMA DISPLAY PANEL

(75) Inventor: Yoshikazu Kanazawa, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 198 days.

(21) Appl. No.: 10/315,070

(22) Filed: Dec. 10, 2002

(65) Prior Publication Data

US 2003/0174105 A1 Sep. 18, 2003

(30) Foreign Application Priority Data

Mar. 15, 2002 (JP) ..... 2002-072858

(51) Int. Cl.[7] ..... G09G 3/28
(52) U.S. Cl. ..... 345/60; 315/169.4
(58) Field of Search ..... 345/60, 61, 66, 345/68; 315/169.4

(56) References Cited

U.S. PATENT DOCUMENTS

| | | | | |
|---|---|---|---|---|
| 5,982,344 | A | 11/1999 | Tokunaga | |
| 6,140,984 | A | 10/2000 | Kanazawa et al. | |
| 6,407,506 | B1 | 6/2002 | Naka et al. | |
| 6,597,334 | B1 | 7/2003 | Nakamura | |
| 2002/0171609 | A1 * | 11/2002 | Tanaka | 345/60 |
| 2004/0075398 | A1 * | 4/2004 | Mima | 315/169.4 |

FOREIGN PATENT DOCUMENTS

| | | |
|---|---|---|
| EP | 0 762 373 A2 | 3/1997 |
| EP | 0 790 597 | 8/1997 |
| EP | 0 810 577 | 12/1997 |
| JP | 6-337654 | 12/1994 |
| JP | 9-311661 | 12/1997 |
| JP | 2000-66636 | 3/2000 |
| JP | 2000-347616 | 12/2000 |

* cited by examiner

*Primary Examiner*—Richard Hjerpe
*Assistant Examiner*—Ke Xiao
(74) *Attorney, Agent, or Firm*—Staas & Halsey LLP

(57) ABSTRACT

A driving method and a plasma display apparatus of a plasma display panel, that provides stable operations even if the width of a scan pulse is reduced, has been disclosed. In this apparatus, an auxiliary scan pulse is applied to an X electrode after a scan pulse applied to a Y electrode (second electrode) is removed. In this way, a discharge is caused to occur between an address electrode and the Y electrode propagates to the space between the X electrode and the Y electrode, and the discharge between the X electrode and the Y electrode develops after the scan pulse is removed and a sufficient amount of wall charges is formed.

22 Claims, 16 Drawing Sheets

IN NORMAL STATE

WHEN LUMINANCE IS LOW, POWER IS SUPPRESSED, ETC.

WHEN ADDRESS PERIOD IS EXPANDED

DRIVING METHOD AND PLASMA DISPLAY APPARATUS OF PLASMA DISPLAY PANEL

BACKGROUND OF THE INVENTION

The present invention relates to a driving method and a plasma display apparatus of a three-electrode AC type plasma display panel.

A plasma display apparatus (PDP apparatus) has been put to practical use as a plane display. A description is given below with an example of a three-electrode AC type plasma display panel.

FIG. 1 is a diagram that shows the structure of a normal plasma display panel. As shown schematically, on a substrate 1, plural X (first) electrodes X1, X2, . . . , and Y (second) electrodes Y1, Y2, . . . that extend in one direction are arranged adjacently by turns and plural address electrodes A are further arranged in the direction perpendicular to that of the X electrodes and the Y electrodes. Between the address electrodes, stripe-shaped ribs 2 that extend along the address electrodes are formed. Normally, the X electrodes and the Y electrodes are formed on one of two substrates, the address electrodes are formed on the other substrate, the two substrates are arranged in such a way as to oppose each other, and a gas for discharge is sealed in into a space between them. Display cells are formed at the crossings of pairs of the X electrodes and the Y electrodes, that is, the pair of X1 and Y1, the pair of X2, Y2, . . . and the address electrodes A. Display lines L1, L2, . . . , are, therefore, formed in correspondence with the pairs of the X electrodes and the Y electrodes, that is the pair of X1 and Y1, the pair of X2 and Y2, . . . , as shown schematically.

FIG. 2 is a block diagram that shows the general structure of a conventional PDP apparatus, that uses a plasma display panel 10, shown in FIG. 1. As shown schematically, the PDP apparatus comprises an address driver (a third drive circuit) 11 that selectively applies a voltage to the address electrode A, a Y electrode drive circuit (a second drive circuit) 12 that drives the Y electrode, an X electrode drive circuit (a first drive circuit) 16 that drives the X electrode, and a control circuit 19. The Y electrode drive circuit 12 comprises a scan driver 13 that generates a scan pulse to be applied sequentially to the Y electrode during the address period, a sustain pulse circuit 14 that generates a sustain pulse to be applied sequentially to the Y electrode during the sustain discharge period, and a reset/address voltage generation circuit 15 that generates a voltage to be applied commonly to the Y electrode during the reset period and that except for the scan pulse to be applied commonly to the Y electrode during the address period. The X electrode drive circuit 16 comprises a sustain pulse circuit 17 that generates a sustain pulse to be applied commonly to the Y electrode during the sustain discharge period and a reset/address voltage generation circuit 18 that generates a voltage to be applied commonly to the X electrode during the reset period and the address period.

FIG. 3 is a diagram that shows the drive waveforms of the PDP apparatus in FIG. 2. As shown schematically, one action cycle comprises a reset period during which all the display cells are brought into a uniform state, an address period during which a display cell to be lit is selected, and a sustain discharge period during which only the selected display cell is lit. The luminance is determined by the number of sustain pulses in the sustain discharge period. When the frequency of the sustain pulse is constant, the number of sustain pulses is in proportion to the length of the sustain discharge period. The PDP apparatus is only able to select the lit or unlit state of each display cell, therefore, when an image with gradation is displayed, one display field is constructed by plural subfields which have the action cycle shown in FIG. 3, and the length of the sustain discharge period of which differs at least in part, and the subfields to be lit are selected for each display cell.

In the reset period, the address driver 11 applies 0V to all the address electrodes and the reset/address voltage generation circuit 18 of the X electrode drive circuit 16 and the reset/address voltage generation circuit 15 of the Y electrode drive circuit 12 apply the voltages as shown in FIG. 3 to all the X electrodes and all the Y electrodes. The reset period is composed of a write portion that applies a positive voltage to the Y electrode as well as applying a negative voltage to the X electrode and an erase portion that applies a negative voltage to the Y electrode as well as applying a positive voltage to the X electrode. In the write portion, after the negative voltage applied to the X electrode is changed gradually, a positive voltage that changes gradually is applied to the Y electrode, and wall charges are formed in all the display cells by a slight discharge. In the erase portion, the voltage applied to the X electrode is switched to a positive one and simultaneously a negative voltage that changes gradually is applied to the Y electrode so that the wall charges in all the display cells are erased or adjusted to a certain amount by a slight discharge. In the address period, in a state in which a voltage Vx is being applied to all the X electrodes, the scan pulse is applied sequentially to the Y electrode and the address pulse that corresponds to the display data is applied selectively to the address electrode in synchronization with the scan pulse. An address discharge is caused to occur in the cell at the crossing of the Y electrode to which the scan pulse is applied and the address electrode to which the address pulse is applied, and no discharge is caused to occur in the cell at the crossing of the address electrode to which the address pulse is not applied. Wall charges are formed in the cell in which the address discharge is caused to occur and each display cell is brought into a state that corresponds to the display data. In the sustain discharge period, in a state in which 0V is being applied to the address electrode, a sustain pulse that change between 0V and a voltage Vs is applied alternately to the Y electrode and the x electrode. A sustain discharge is caused to occur in the cell in which wall charges are accumulated during the address period because the voltage due to the wall charges is added to the sustain pulse and the discharge start voltage is exceeded, and no sustain discharge is caused to occur in the cell in which no wall charge is accumulate during the address period. The wall charges are formed alternately on the Y electrode and the X electrode by the sustain discharge, and the sustain discharge continues as long as the sustain pulse is being applied.

The typical method of the PDP apparatus is described above as an example, but various kinds of methods are put to practical use and there are many examples of modifications.

Recently, the display apparatus has been highly improved in capacity and resolution, and the plasma display panel has increased the number of lines from approximately 500 to 1,000. Moreover, it is required that the number of levels in gradation should be increased and that the number of subfields should be increased to avoid the false contour when a motion video is displayed, which is inherent in a device that performs display using subfields. If the number of display lines is increased, the number of times an addressing is performed is increased and the time to be assigned to one address action, that is, the width of the scan pulse becomes shorter. If the number of subfields is increased, the time to be assigned to the address period becomes shorter and it is necessary to shorten the width of the scan pulse. If, however, the width of the scan pulse is shortened, a problem occurs in that no address discharge is caused to occur, even though an address pulse is applied, and display data cannot be written correctly.

One of the methods to solve the problem is the so-called dual scan method, in which the address period is halved by dividing the address electrode horizontally and performing the address action simultaneously in the upper screen and the lower screen. This method, however, brings about a problem that two address drivers to drive the address electrode are required, resulting in the disadvantage of a higher cost.

Another method has been proposed in which the address of one display line is performed at a high-speed. For example, sufficient space charges that are generated by the reset discharge during the reset period are made to remain, thereby the address discharge is made more likely to occur and the delay time of the address discharge is shortened. It is, however, necessary to increase the intensity of the reset discharge in order to generate a sufficient amount of space charges and a problem is caused in that the quality of display is degraded because the entire surface light emission intensity due to the reset discharge increases and the contrast is degraded.

Moreover, there is another method in which the voltage to be applied during the address discharge is increased to promote the development of the discharge and the address discharge is completed in a short time. This method, however, brings about various problems of such as crosstalk between the neighboring cells and lack of control of the discharge.

On the other hand, Japanese unexamined Patent Publication (Kokai) No. 9-311661 has disclosed the method in which the absolute value of the voltage of the scan pulse to be applied to the Y electrode is reduced by providing the scan driver also to the X electrode drive circuit and by applying the scan pulse of the opposite polarity to the X electrode in synchronization with the application of scan pulse to the Y electrode during the address period. The advantage of this method lies in the fact that the withstand voltage of the drive circuit can be reduced, but the same problem, as described above, may occur when the width of the scan pulse becomes short.

The address discharge is started when the address pulse is applied to the address electrode and the scan pulse is applied to the Y electrode, but an amount of wall charges enough to cause the sustain discharge to occur is not generated only by the discharge between the address electrode and the Y electrode. A high voltage, therefore, is applied to the X electrode so that the discharge caused to occur between the address electrode and the Y electrode causes the discharge to occur between the X electrode and the Y electrode, and the discharge between the X electrode and the Y electrode is completed after it develops to generate the wall charges necessary for the sustain discharge. If the time required for the series of these actions is too short, the discharge between the X electrode and the Y electrode does not develop even though the discharge between the address electrode and the Y electrode is caused to occur, and a state is brought about in which a sufficient amount of wall charges is not formed (a state of imperfect address discharge), therefore, it seems that the sustain discharge is not caused to occur. The term "development of the discharge" described above is used because a certain length of time is required to generate a sufficient amount of wall charges after the discharge is completed.

As described above, the problem lies in the fact that the width of the address pulse needs to be shortened to increase the number of display lines and to improve the gradation reproduction, but this adversely affects the stable actions.

SUMMARY OF THE INVENTION

The objective of the present invention is to realize a driving method and a plasma display panel of a plasma display panel, which can provide stable actions even though the width of a scan pulse is reduced.

In order to realize the above-mentioned objective, an auxiliary scan pulse is applied to the X electrode after the scan pulse applied to the Y electrode (second electrode) is removed. In this way, the discharge caused to occur between the address electrode and the Y electrode causes another discharge to occur between the X electrode and the Y electrode, and the discharge between the X electrode and the Y electrode develops after the scan pulse is removed, resulting in the formation of a sufficient amount of wall charges.

According to the present invention, the voltage between the X electrode and the Y electrode is kept high to a certain degree because the auxiliary scan pulse is applied to the X electrode after the scan pulse applied to the Y electrode is removed. The auxiliary scan pulse is adjusted so that the discharge develops, to form a sufficient amount of wall charges, similar to the case where the scan pulse is applied. As a result, it is possible for the discharge between the X electrode and the Y electrode to keep on developing and a sufficient amount of wall charges necessary for the sustain discharge can be formed even in the case where the period of application of the scan pulse is short and the discharge between the x electrode and the Y electrode has not sufficiently developed in the period.

FIG. 4 is a diagram that shows the waveforms in the reset period and the address period that illustrate the principles of the present invention. As described above, the reset period is mainly composed of the write portion and the erase portion, wherein the write portion has a function to form wall charges by a slight discharge and the erase portion has a function to erase or adjust the wall charges to a fixed amount similarly by a slight discharge. The address discharge is caused to start when the scan pulse is applied to the Y electrode and simultaneously the address pulse is applied to the address electrode of the cell which is to be lit. At this time, the voltage between the X electrode and the Y electrode is adjusted to V2, a little greater than V1, which is the final voltage of the erase portion in the reset period. Then, at the same time as the removal of the scan pulse applied to the Y electrode, the auxiliary scan pulse is applied to the X electrode. At this time, the voltage between the x electrode and the Y electrode is V3. By means of the auxiliary scan pulse, the discharge that has not developed sufficiently during the application of the scan pulse can develop and the wall charges that enable the sustain discharge are formed.

Next the relationships between the voltages are described. If a voltage greater than V1 is applied to the X electrode and the Y electrode in the address period and the sustain discharge period, while the voltage of the erase portion in the reset period is V1, a discharge is caused to start even in a cell in which no address discharge has been caused to occur. Basically, therefore, the voltage between the X electrode and the Y electrode in the address period and the sustain discharge period is adjusted to be less than V1. In the case, however, where the pulse width is very short (approximately 1 μs to 2 μs such as the scan pulse, V2 is adjusted so as to be greater than V1 by approximately 10V to 20V because no discharge is caused to start even though a voltage greater than V1 is applied. In this way, it is also possible to increase the start speed and the probability of occurrence of the address discharge. It is not necessary to adjust V3 to as large as V2 because V3 is used to further develop the address discharge caused to occur in the period of application of the scan pulse. As a rough standard, it should be adjusted to be equal to or a little less than V1. It is also possible to adjust it the same voltage as the sustain discharge pulse in order to make the power source and the drive circuit common. Moreover, as the width of the auxiliary scan pulse can be adjusted to be longer than that of the scan pulse by rearranging the order of application of the scan pulse, it is possible to form a sufficient amount of wall charges with a low voltage.

BRIEF DESCRIPTION OF THE DRAWINGS

The features and advantages of the present invention will be more clearly understood from the following description taken in conjunction with the accompanying drawings, in which.

DESCRIPTION OF THE PREFERRED EMBODIMENTS

Figure 5:
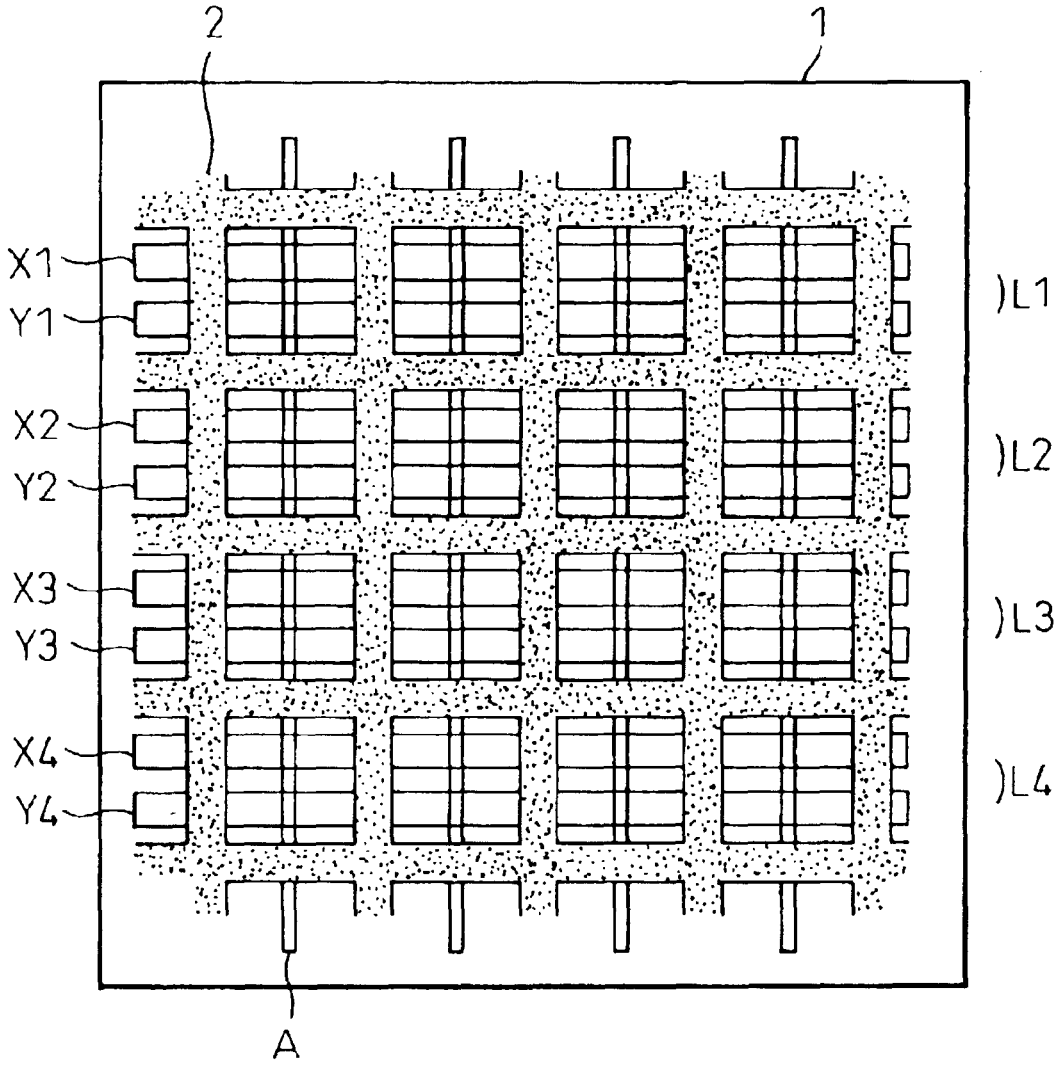
FIG. 5 is a diagram that shows the structure of the plasma display panel used in the first embodiment of the present invention.

FIG. 5 is a diagram that shows the structure of the plasma display panel 10 used in the PDP apparatus in the first embodiment of the present invention. The plasma display panel in FIG. 5 differs from that in FIG. 1 in that the ribs have a two-dimensional grid shape and each display cell is separated for each pair of the X electrode and the Y electrode. In the plasma display panel in FIG. 5, therefore, it is unlikely that a discharge caused in a display cell propagates to the neighboring cells.

Figure 2:
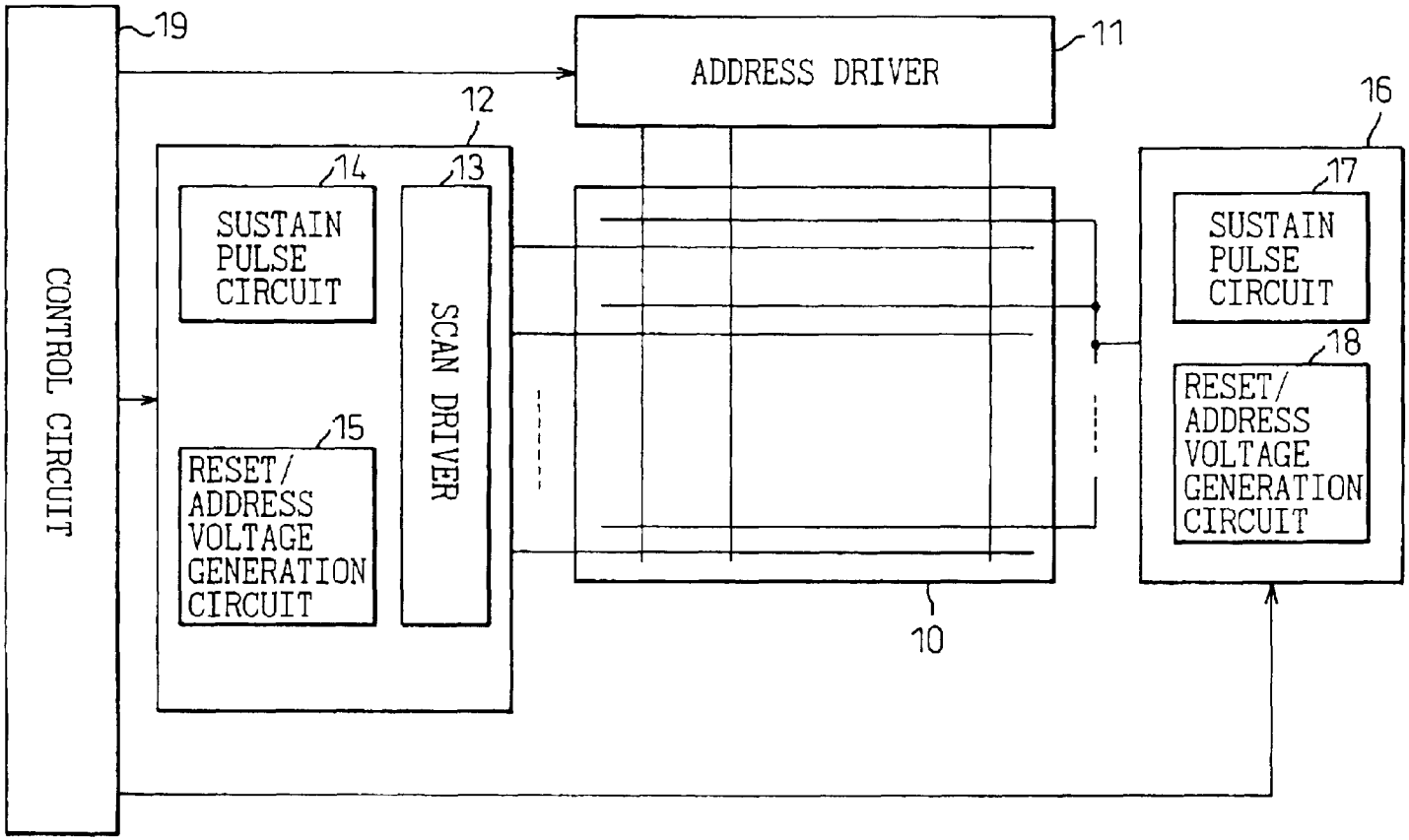
FIG. 2 is a block diagram that shows the rough structure of the conventional plasma display (PDP) apparatus.
Figure 6:
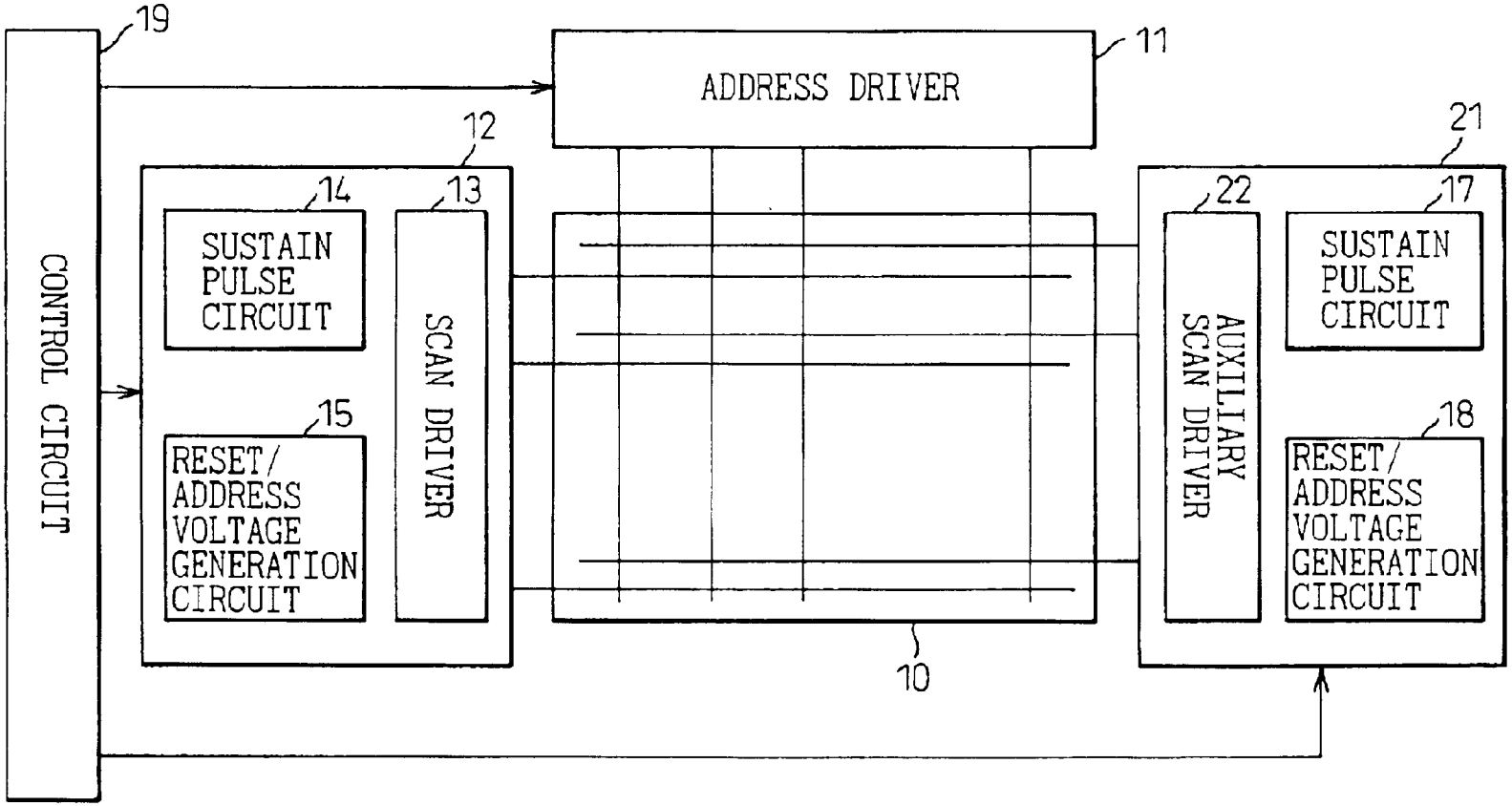
FIG. 6 is a block diagram that shows the rough structure of the PDP apparatus in the first embodiment.

FIG. 6 is a block diagram that shows the rough structure of the PDP apparatus in the first embodiment. As obvious by comparison with FIG. 2, it differs from the conventional PDP apparatus in that an X electrode drive circuit 21 comprises an auxiliary scan driver 22 that puts out an auxiliary scan pulse. The auxiliary scan driver 22 can be realized by, for example, the same structure as used for the scan driver 13.

Figure 3:
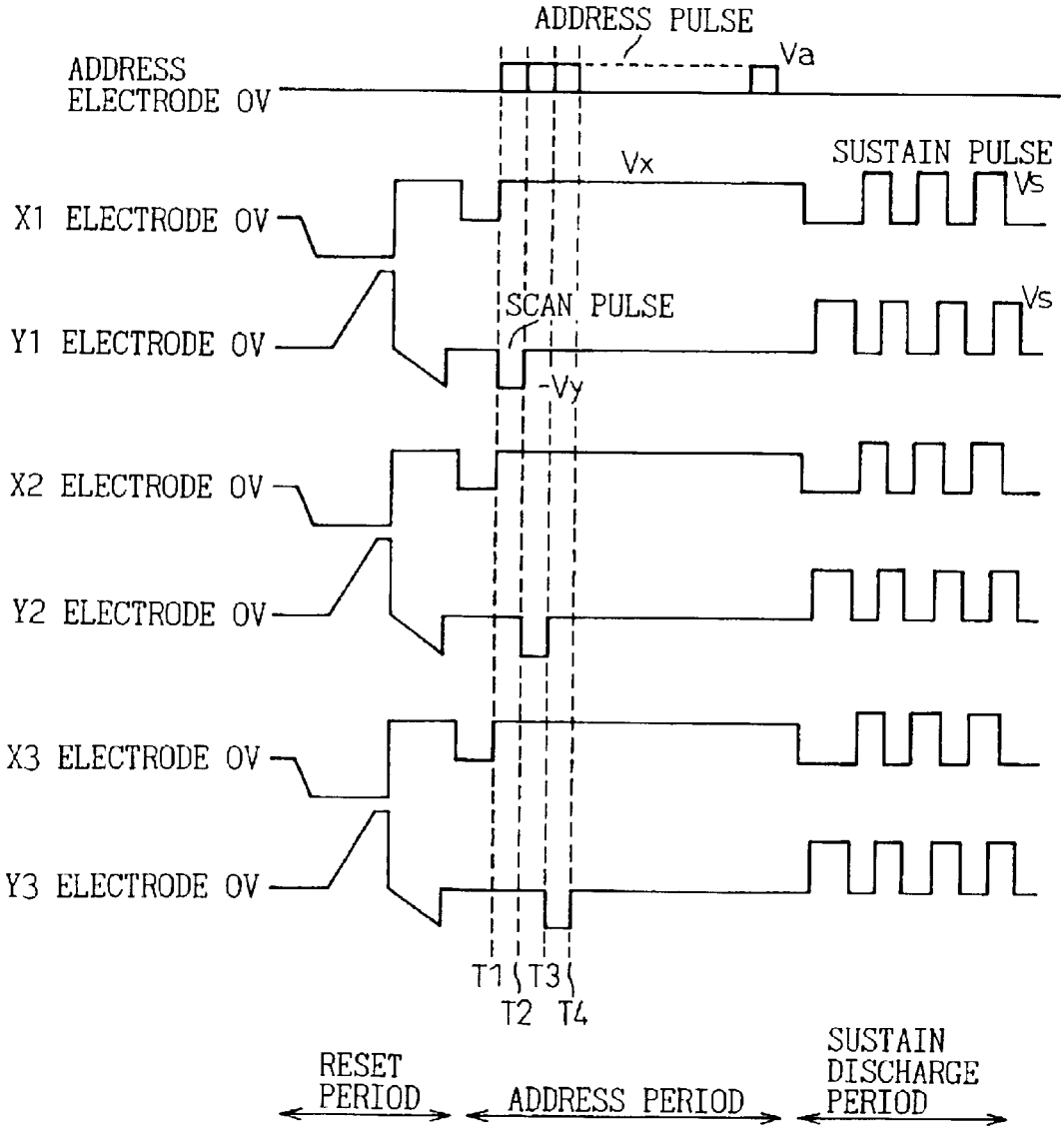
FIG. 3 is a diagram that shows the drive waveforms of the conventional PDP apparatus.
Figure 4:
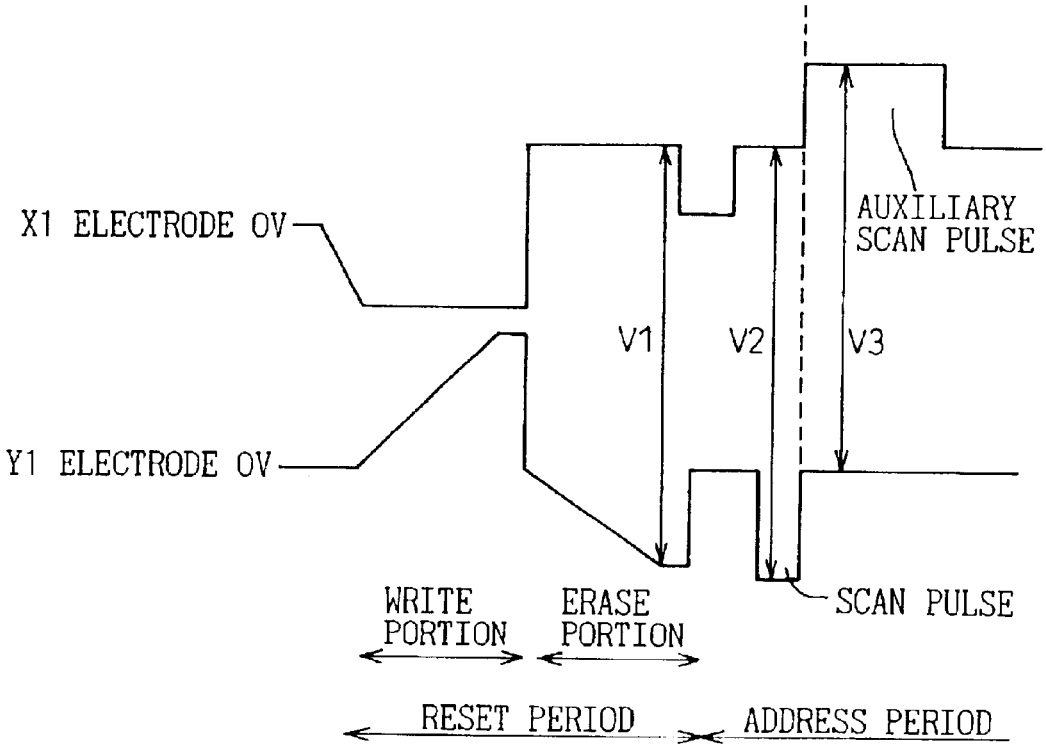
FIG. 4 is a diagram that shows the waveforms that illustrate the principles of the present invention.
Figure 7:
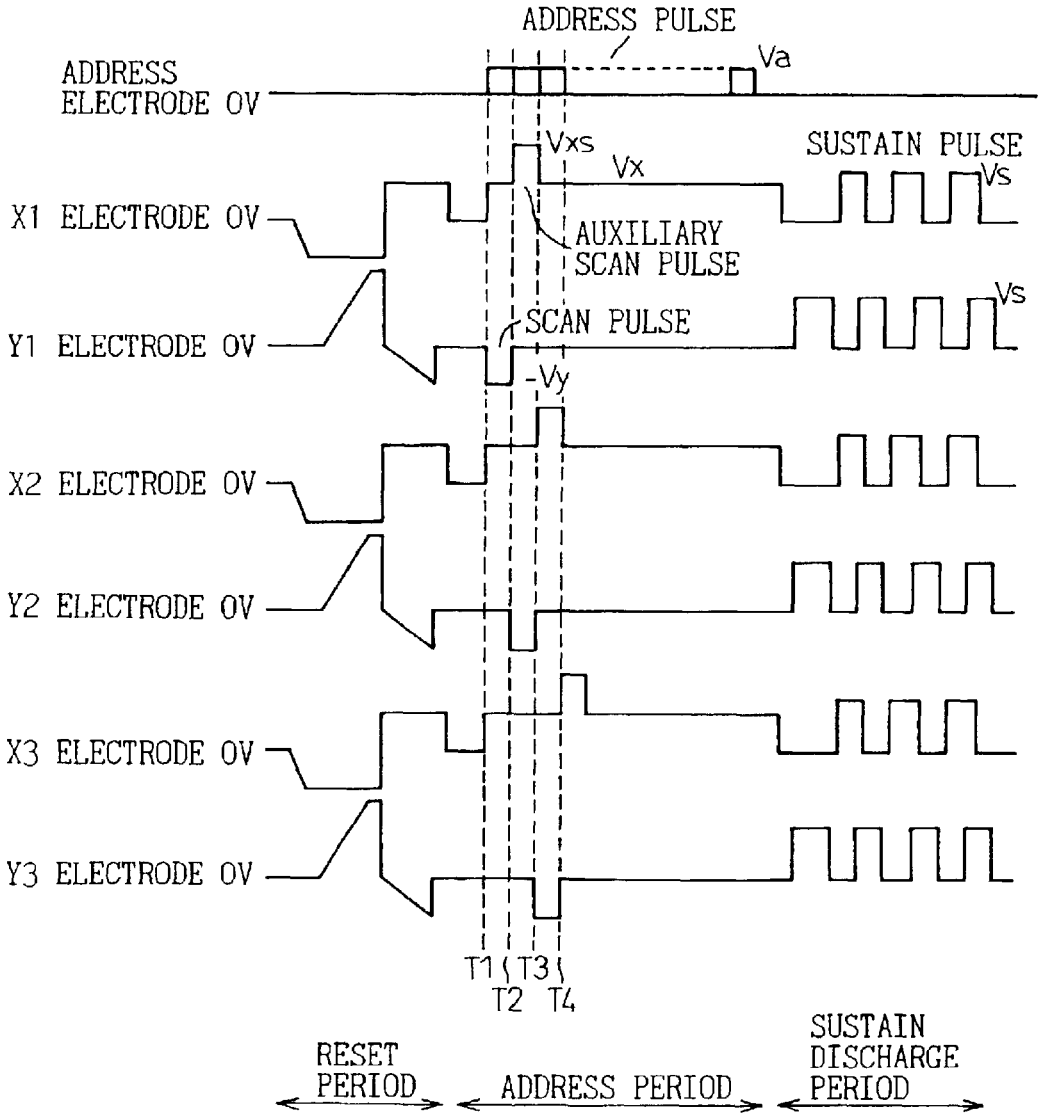
FIG. 7 is a diagram that shows the drive waveforms of the PDP apparatus in the first embodiment.

FIG. 7 is a diagram that shows the drive waveforms in the first embodiment. As obvious by comparison with FIG. 3, they differ in that the auxiliary scan pulse is applied to the X electrode in the address period. The operations in the first embodiment are described in detail below.

In the reset period, the initializing operation is carried out as before, and all the display cells are brought into a uniform state. In the period denoted by T1 in the address period, the scan pulse of voltage of −Vy (−150V) is applied to the Y1 electrode, and simultaneously the address pulse of voltage of Va (50V) is applied to the address electrode that corresponds to the cell to be lit in the display line L1 formed by the X1 electrode and the Y1 electrode. In this way, the address discharge is caused to start between the address electrode and the Y1 electrode. At this time, as the voltage of Vx (50V) is being applied to the X electrode, the discharge propagates to the space between the X1 electrode and the Y1 electrode. A sufficient amount of wall charge, however, is not formed in the period T1. In the next period T2, the scan pulse is removed from the Y1 electrode and the scan pulse is applied to the Y2 electrode. Simultaneously, the auxiliary scan pulse of voltage of Vsx (180V) is applied to the X1 electrode. In this way, the discharge between the X1 electrode and the Y1 electrode keeps on developing and an amount of wall charge sufficient for the sustain discharge is formed. At this time, the address pulse is applied to the address electrode that corresponds to the cell to be lit in the display line L2 formed by the X2 electrode and the Y2 electrode, and the address discharge is caused to occur. In the next period T3, the scan pulse is applied to the Y3 electrode and the auxiliary scan pulse is applied to the X2 electrode, as similarly to the period T2. The address discharge is caused to occur in the entire area by performing these operations sequentially. In the sustain discharge period, the sustain pulse is applied to the x electrode and the Y electrode, similarly as before.

Figure 8:
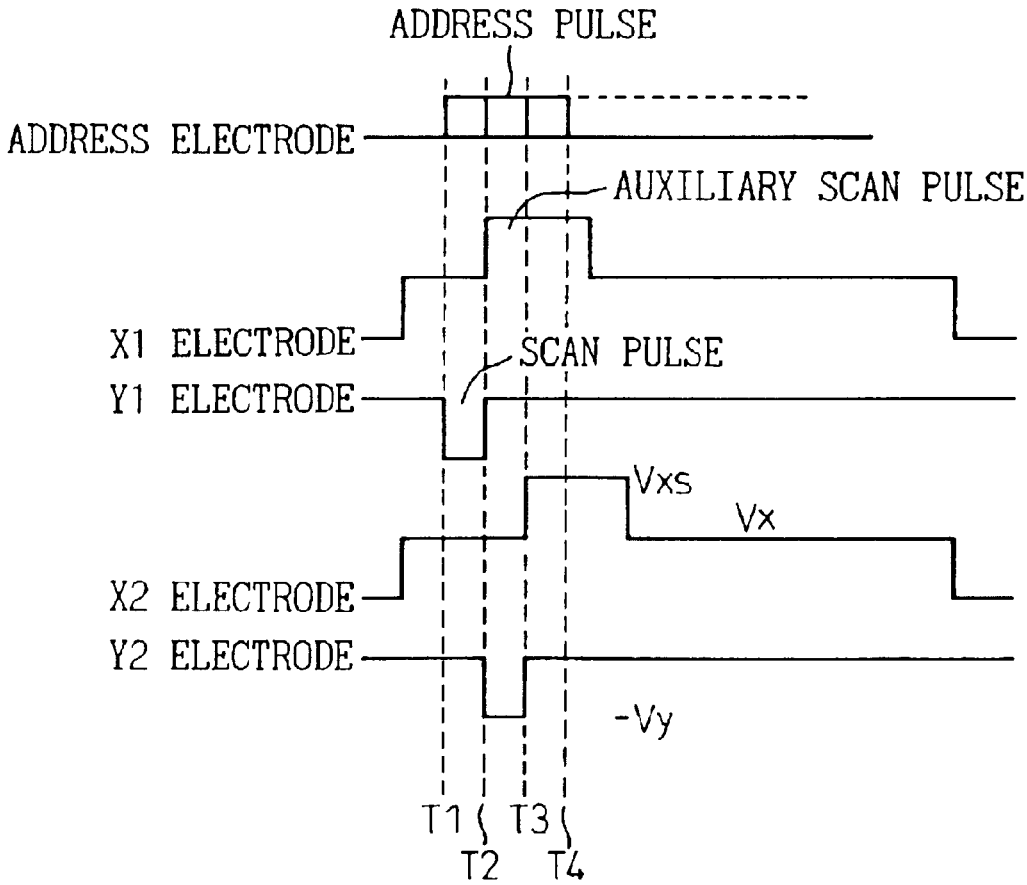
FIG. 8 is a diagram that shows the modification examples of the drive waveforms.

In the drive waveforms in FIG. 7, the pulse width of the auxiliary scan pulse is the same as that of the scan pulse, but this is not limited and can be adjusted arbitrarily. For example, if the width of the auxiliary scan pulse is made longer than that of the scan pulse, as shown in FIG. 8, it brings about an advantage in forming more wall charges.

Also in the PDP apparatus in the first embodiment, one display field is composed of plural subfields, the luminance is varied by changing the length of the sustain discharge period of at least part of the subfields, and the subfields to be lit are combined to obtain the gradation display. The lengths of the reset period and the address period of each subfield are fixed.

Next, the PDP apparatus in the second embodiment of the present invention is described. The PDP apparatus in the second embodiment has a structure almost the same as that of the PDP apparatus in the first embodiment, but it differs from that in the first embodiment in that the length of the address period in the subfield is controlled according to variables such as the power consumption. The control is carried out by the control circuit 19.

Figure 9A:
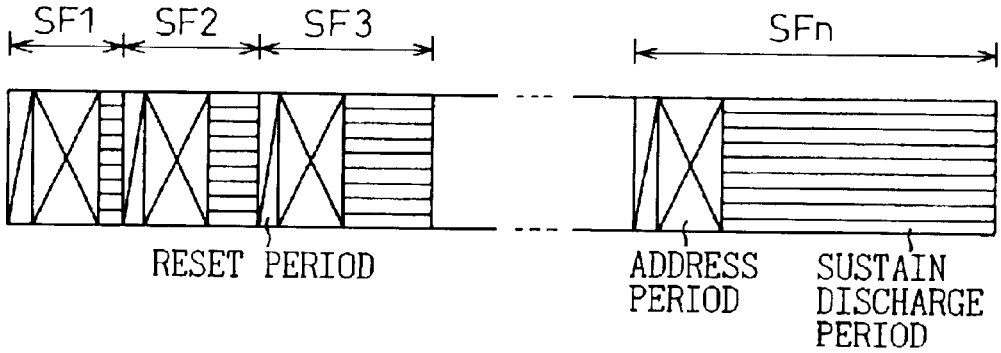
FIG. 9A to FIG. 9C are diagrams that illustrate the length control of the address period of the PDP apparatus in the second embodiment of the present invention.
Figure 9B:
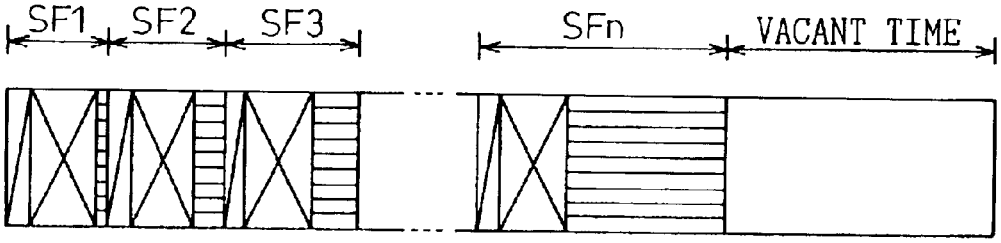
Figure 9C:
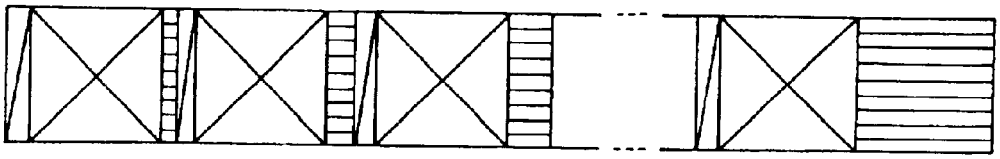

FIG. 9A to FIG. 9C are diagrams that illustrate the control of the length of the address period in the second embodiment of the present invention, wherein FIG. 9A shows the structure of the subfield in a normal state, FIG. 9B shows that when the sustain discharge period is shortened while the luminance is low and the power is suppressed, and FIG. 9C shows that when the address period is expanded while the luminance is low and the power is suppressed.

Figure 10A:
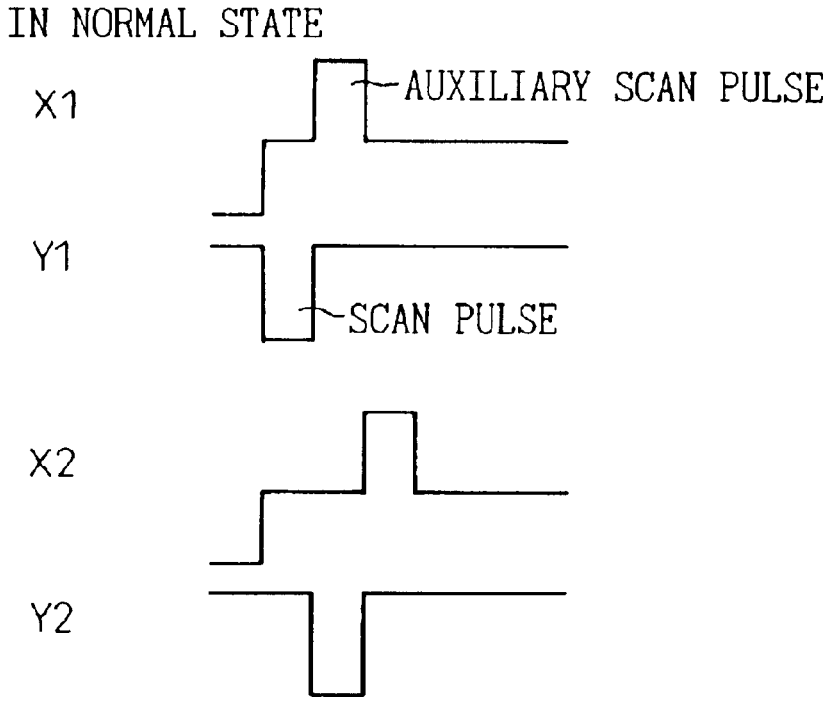
FIG. 10A and FIG. 10B are diagrams that show the drive waveforms in the address period in the second embodiment.

As shown in FIG. 9A, the whole period of a display field is assigned to the subfields SF1 to SFn in a normal state so that no vacant time is produced. The lengths of the reset period and the address period of each subfield are equal and the length of the sustain discharge period is adjusted in accordance with the luminance. The waveforms in a normal state are the same as those in the first embodiment shown in FIG. 7, and the scan pulse is applied sequentially to the Y electrode and the auxiliary scan pulse is applied to the X electrode after the scan pulse is removed in the address period, as shown in FIG. 10A.

In the PDP apparatus, when the luminance is kept low or when the power exceeds the permissible limit if displayed as it is with a high display ratio, control is carried out in which the length of the sustain discharge period of each subfield is shortened with the luminance ratio of subfields being kept unchanged and the number of sustain discharge pulses in the entire plasma display panel is suppressed. In the PDP apparatus in the second embodiment, the same control is carried out. When the control is carried out, if only the length of the sustain discharge period is shortened with the lengths of the reset period and the address period being kept unchanged, a vacant time is produced in a display field as shown in FIG. 9B. In this case, the scan pulse and the auxiliary scan pulse as shown in FIG. 10A are applied in the address period.

Figure 10B:
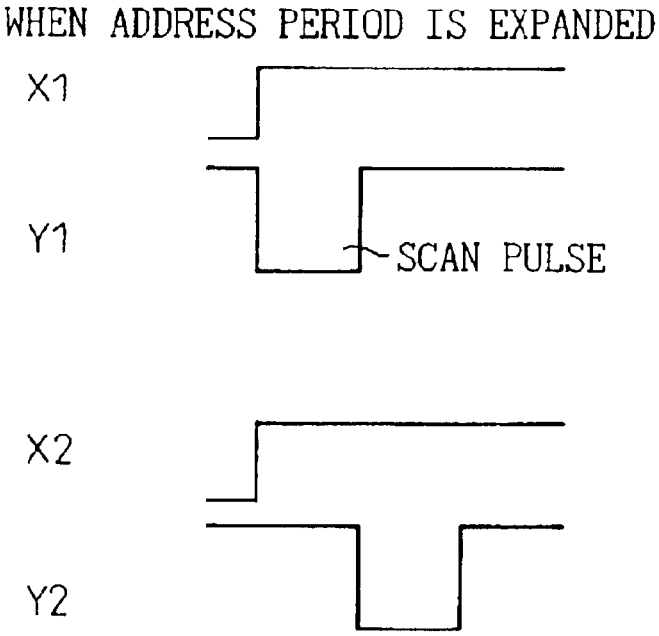

In the second embodiment, when the vacant time shown in FIG. 9B exceeds a fixed length, the width of the scan pulse is widened so that the auxiliary scan pulse is not applied, as shown in FIG. 10B. In this case, the vacant time is eliminated in a display field, as shown in FIG. 9C, and it is possible to expand the length of the address period while keeping the length of the reset period of each subfield equal to each other. Although the auxiliary scan pulse is not used, a sufficient amount of wall charges is formed during the scan pulse period because the width of the scan pulse is widened, and no erroneous write occurs. In this way, since it is no longer necessary to apply the auxiliary scan pulse, the power to be consumed to apply the auxiliary scan pulse can be reduced.

Figure 1:
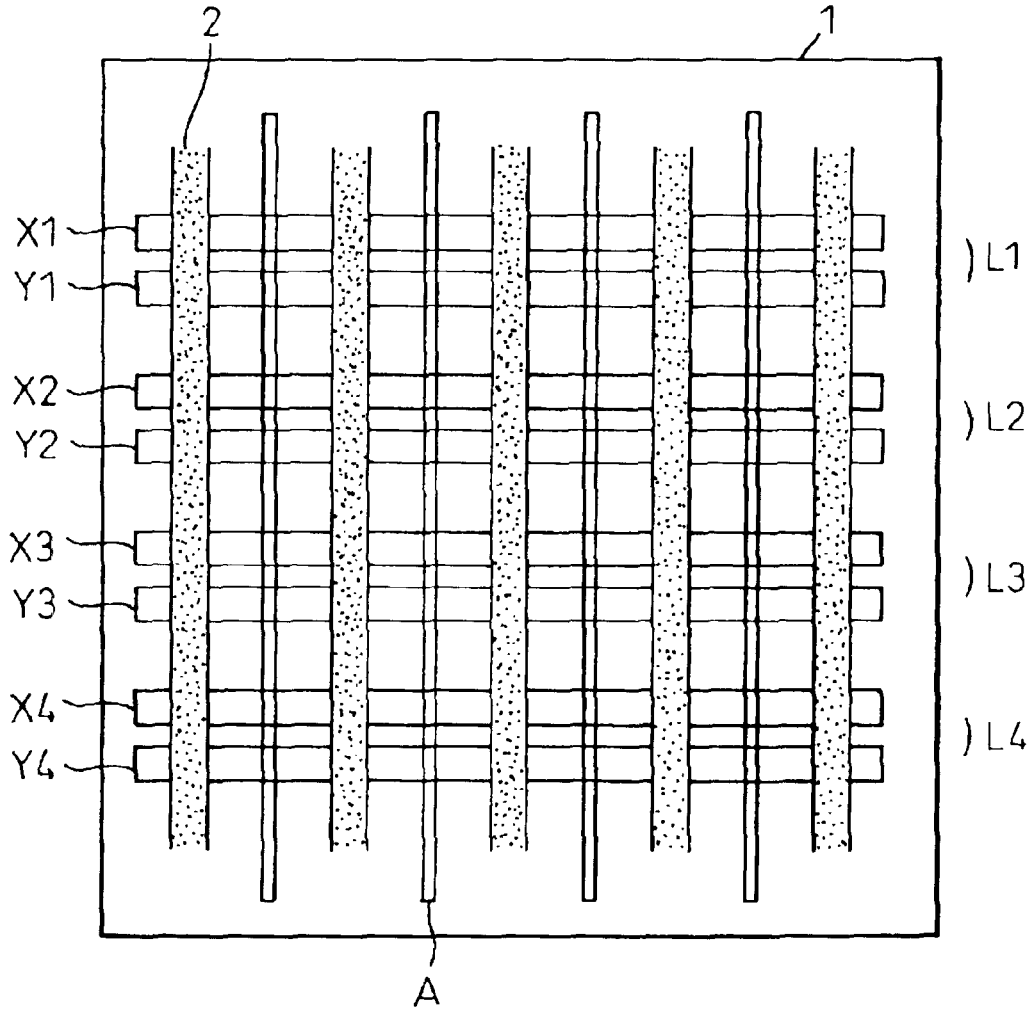
FIG. 1 is a diagram that shows the structure of the normal plasma display panel.

In the driving method in the first embodiment, although the plasma display panel is used, which has the two-dimensional grid-like ribs as shown in FIG. 5 and in which the individual display cells are separated by the ribs, it is also possible to use the plasma display panel that has the stripe-shaped ribs as shown in FIG. 1. In the period T2 in FIG. 7, however, another discharge after the address discharge between the X1 electrode and the Y1 electrode is caused to occur and the address discharge between the Y2 electrode and the address electrode is also caused to start. When discharges are caused to occur simultaneously in both the neighboring display cells, it is likely that interference between them occurs. As the panel used in the first embodiment has the two-dimensional grid-shaped ribs as shown in FIG. 5, it is unlikely that interference between the neighboring display lines occurs because individual display cells are separated by the ribs. In the case of the plasma display panel that has the stripe-shaped ribs as shown in FIG. 1, however, a problem may be caused in that interference occurs between the display line L1 formed by the X1 electrode and the Y1 electrode and the display line L2 formed by the X2 electrode and the Y2 electrode, and an erroneous write that brings about a state of the cell different from the display data occurs, and so on. It is, of course, possible to prevent interference by, for example, increasing the distance between the X electrode and the Y electrode of each pair, and the driving method in the first embodiment can be applied in this case. When, however, the plasma display panel shown in FIG. 1 is used it is desirable that the drive waveforms in the third embodiment are used as will be described below.

Figure 11:
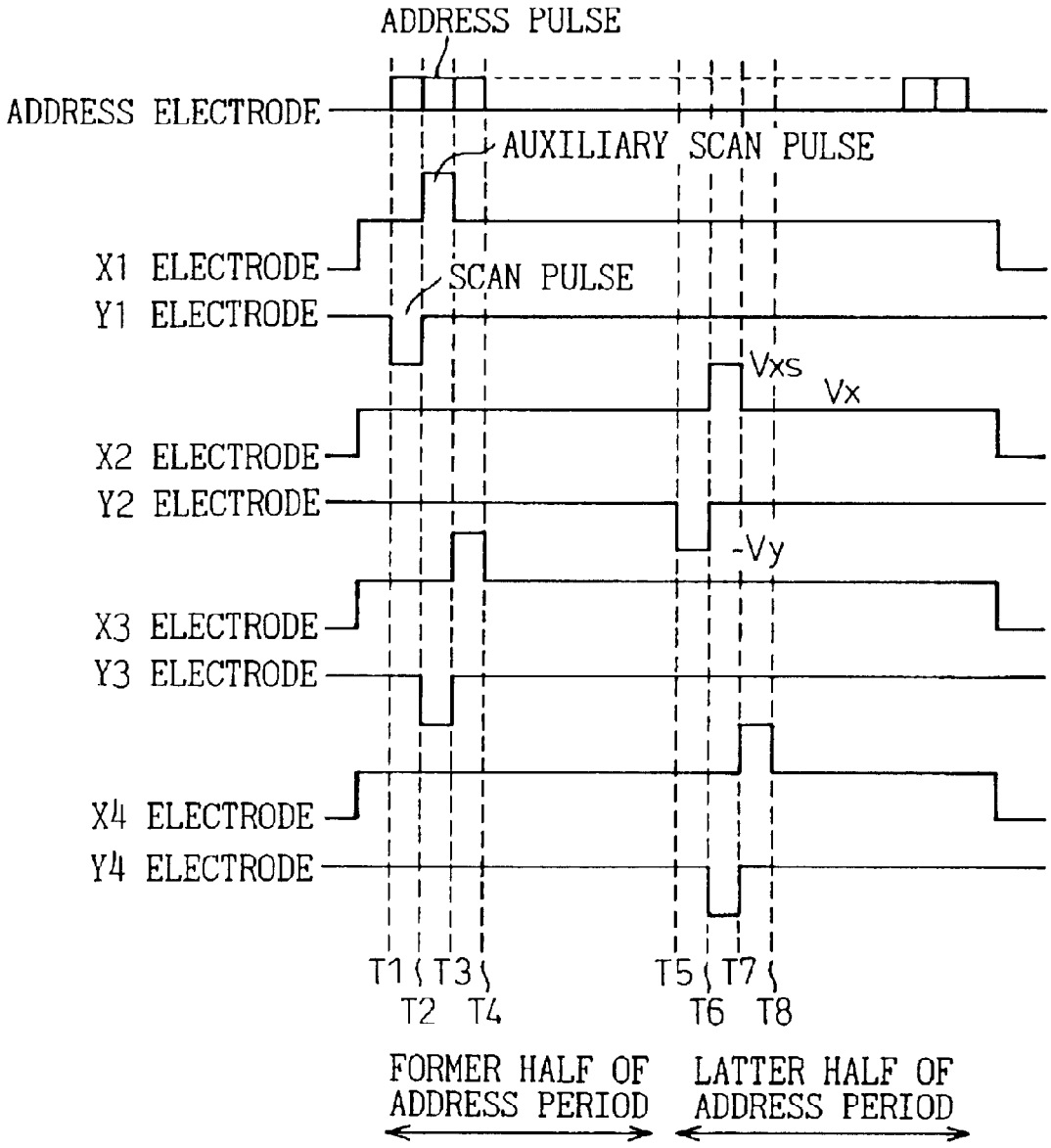
FIG. 11 is a diagram that shows the drive waveforms of the PDP apparatus in the third embodiment of the present invention.

FIG. 11 is a diagram that shows the drive waveforms of the PDP apparatus in the third embodiment. The rough structure of the PDP apparatus is the same as that in the first embodiment shown in FIG. 6 and it differs only in that the sequence in which the scan pulse and the auxiliary scan pulse are applied. In the third embodiment, the Y electrodes are divided into two groups, an odd-numbered Y electrode group and an even-numbered Y electrode group, and in the first half of the address period, the scan pulse is applied sequentially to the odd-numbered Y electrode group and the scan pulse is applied sequentially to the even-numbered Y electrode group in the second half of the address period to cause the address discharge to occur. In accordance with this, the X electrodes are also divided into two groups, an odd-numbered X electrode group and an even-numbered x electrode group and, in a state in which a voltage of Vx is being applied to the odd-numbered and even-numbered X electrode groups, the auxiliary scan pulse is applied sequentially to the odd-numbered X electrode group so as to overlap Vx after the scan pulse sequentially applied to the odd-numbered Y electrode is removed in the first half of the address period, and in the second half of the address period, the auxiliary scan pulse is sequentially applied to the even-numbered x electrode group so as to overlap Vx after the scan pulse sequentially applied to the even-numbered Y electrode group is removed. In this way, it is possible to prevent the address discharge from occurring and developing simultaneously in the neighboring display lines and thus the interference can be avoided.

Figure 12:
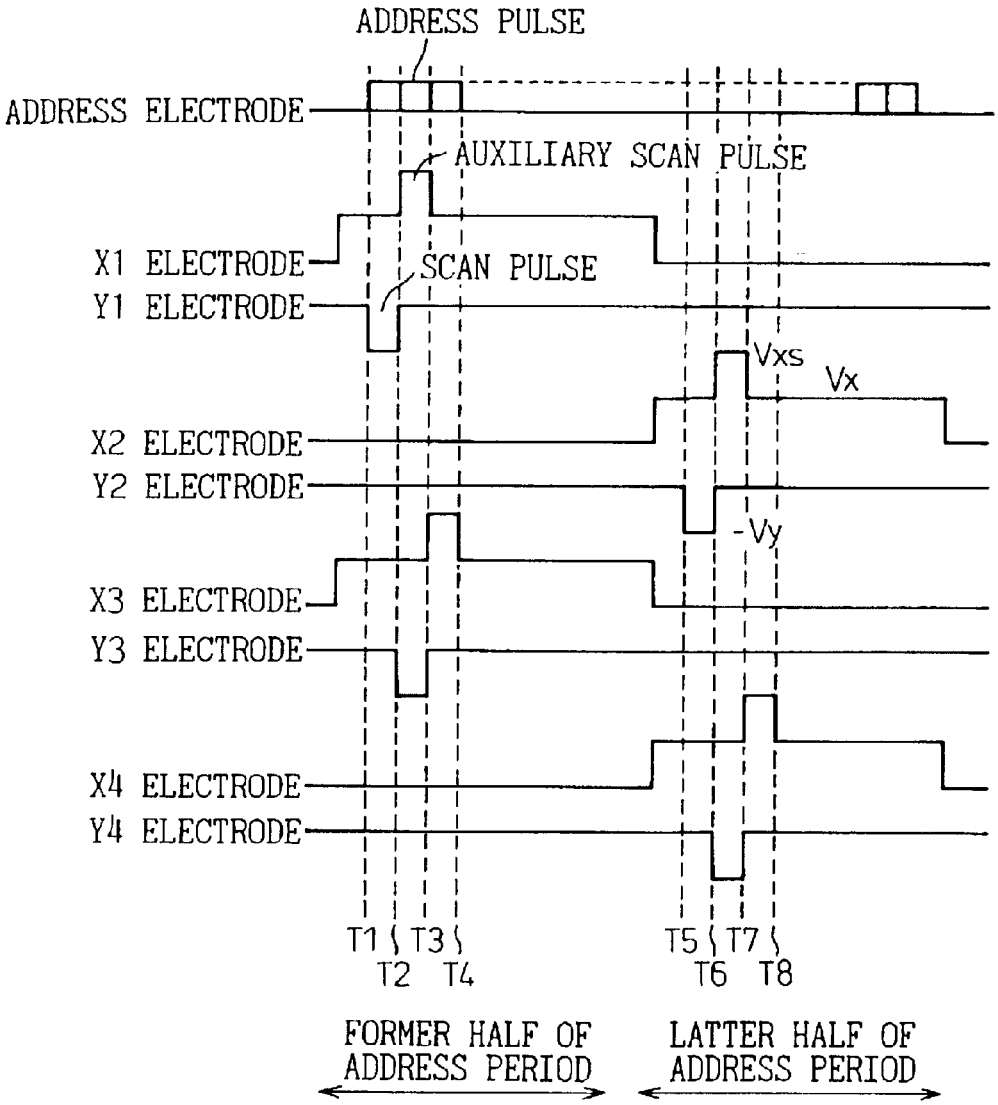
FIG. 12 is a diagram that shows the drive waveforms of the PDP apparatus in the fourth embodiment of the present invention.

FIG. 12 is a diagram that shows the waveforms of the PDP apparatus in the fourth embodiment of the present invention. The driving method in the fourth embodiment is also appropriate to drive the plasma display panel shown in FIG. 1 and, in addition, it is more appropriate to drive a plasma display panel of finer resolution because it is more unlikely that interference is caused to occur compared to the case of the drive waveforms in the third embodiment. The drive waveforms in the fourth embodiment differ in that 0V is applied to the even-numbered X electrode group in the first half of the address period and 0V is applied to the odd-numbered X electrode group in the second half of the address period. Concretely speaking, in the first half of the address period, in a state in which 0V is being applied to the even-numbered X electrode group and Vx is being applied to the odd-numbered X electrode, the scan pulse is sequentially applied to the odd-numbered Y electrode group, and the auxiliary scan pulse is sequentially applied to the odd-numbered X electrode group so as to overlap Vx after the scan pulse is removed. In the second half of the address period, in a state in which 0V is being applied to the odd-numbered X electrode group and Vx is being applied to the even-numbered X electrode group, the scan pulse is sequentially applied to the even-numbered Y electrode group and the auxiliary scan pulse is sequentially applied to the even-numbered X electrode group so as to overlap Vx after the scan pulse is removed.

In the third embodiment, when the scan pulse is applied to the Y1 electrode, Vx is being applied to both the X1 electrode and the X2 electrode, therefore, the voltage between the Y1 electrode and the X2 electrode is large. As a result, there is a possibility that if an address discharge is caused to occur between the Y1 electrode and the X1 electrode, it may trigger a discharge between the Y1 electrode and the X2 electrode. Contrary to this, in the drive waveforms in the fourth embodiment, when the scan pulse is applied to the Y1 electrode, Vx is being applied to the X1 electrode but 0V is being applied to the X2 electrode, therefore, the voltage between the Y1 electrode and the X2 electrode is small and the possibility of a discharge between the Y1 electrode and the X2 electrode is small and no erroneous discharge is caused to occur.

A finer resolution is required of the PDP apparatus and Japanese Patent No.2001893 has disclosed a PDP apparatus in which a display of fine resolution can be realized at a low cost. In this PDP apparatus, while a display line is formed by a pair of two display electrodes in a conventional PDP apparatus, the number of display lines can be doubled using the same number of display electrodes, or the same number of display lines can be formed by half of the number of electrodes by forming a display line between every pair of neighboring display electrodes. This method is called the ALIS (Alternate Lighting of Surfaces) method. The fifth embodiment is one in which the present invention is applied to the ALIS method PDP apparatus.

Figure 13:
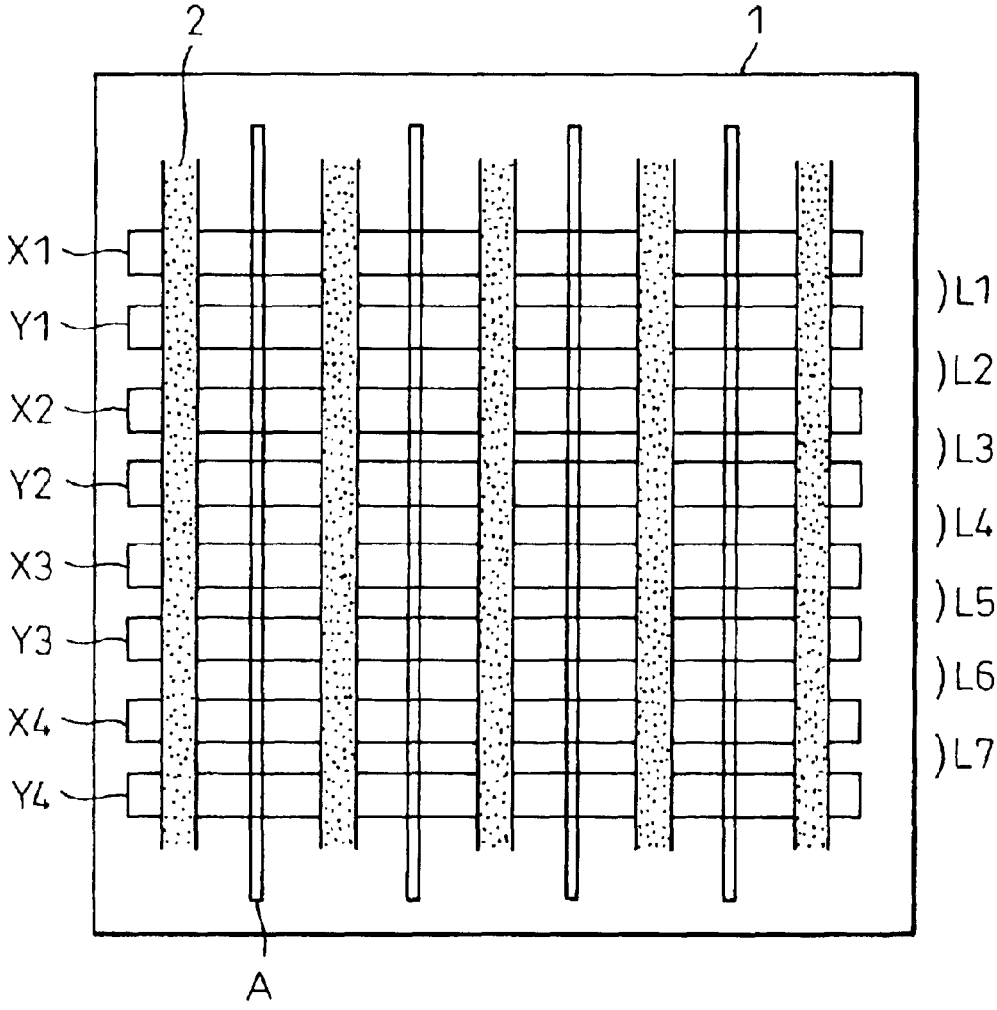
FIG. 13 is a diagram that shows the structure of the plasma display panel used in the fifth embodiment of the present invention.

FIG. 13 is a diagram that shows the structure of an ALIS method plasma display panel. As shown schematically, on the substrate 1, the X electrodes X1, X2, . . . and the Y electrodes Y1, Y2, . . . , which are the same shape, are arranged adjacently by turns and the address electrodes A are arranged in the direction perpendicular thereto, and the ribs 2 are provided between the address electrodes. The display lines L1, L2, . . . are formed between every pair of x electrode and Y electrode, such as between X1 and Y1, between Y1 and X2, and between X2 and Y2. Double of the number of display lines can be, therefore, obtained using the conventional same number of X electrodes and Y electrodes. The display lines L1, L2, . . . are divided into odd-numbered display lines and even-numbered display lines, and the odd-numbered display lines are displayed in the odd-numbered fields and the even-numbered display lines are displayed in the even-numbered fields.

Figure 14:
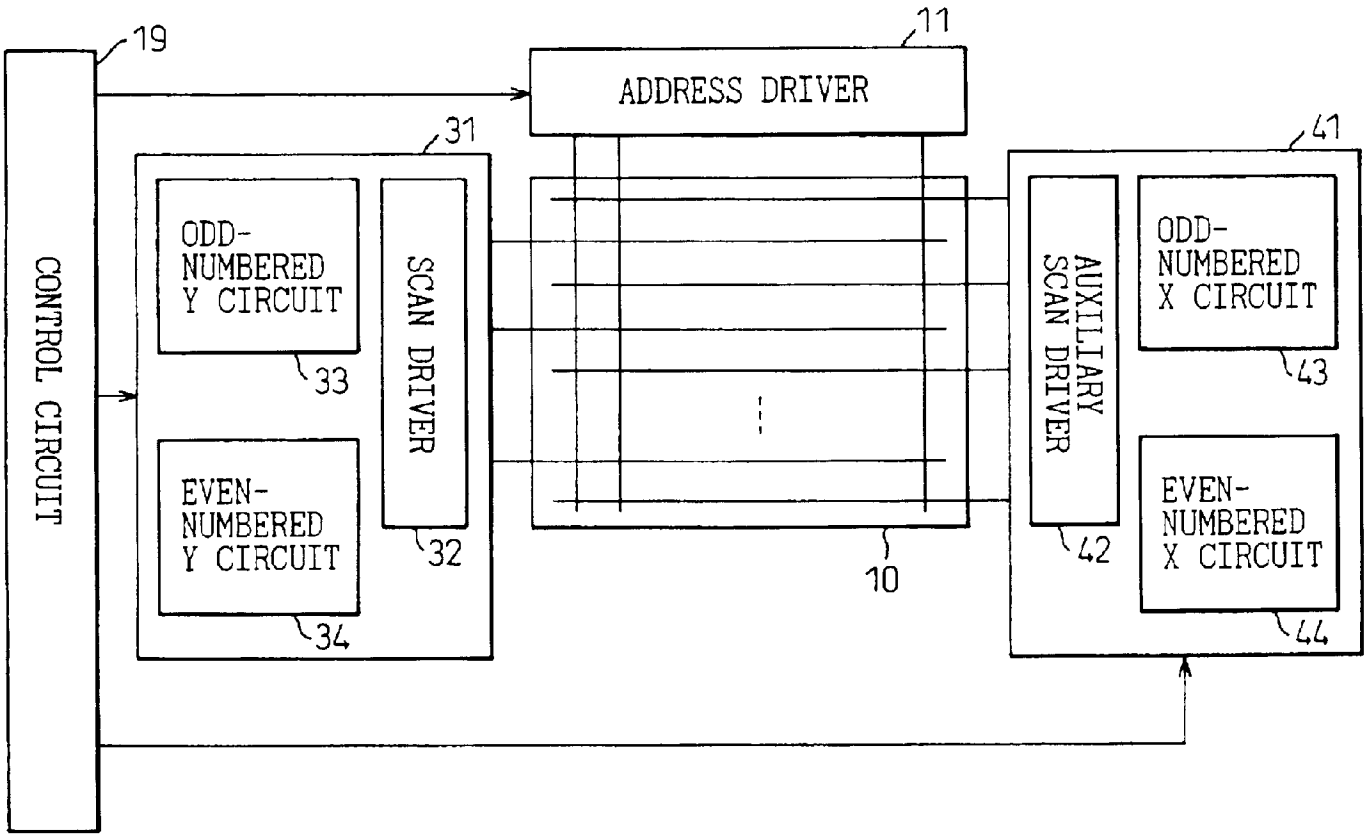
FIG. 14 is a block diagram that shows the rough structure of the PDP apparatus in the fifth embodiment.

FIG. 14 is a block diagram that shows the rough structure of the ALIS method PDP apparatus in the fifth embodiment of the present invention. As shown schematically, the PDP apparatus comprises the plasma display panel 10 that has the panel structure shown in FIG. 13, the address driver 11, a Y electrode drive circuit 31, an X electrode drive circuit 41, and the control circuit 19. In the ALIS method PDP apparatus, it is necessary to divide the X electrodes and the Y electrodes into an odd-numbered electrode group composed of odd-numbered electrodes and an even-numbered electrode group-composed of even-numbered electrodes for driving. The Y electrode drive circuit 31, therefore, comprises a scan driver 32, an odd-numbered Y circuit 33 and an even-numbered Y circuit 34. The odd-numbered Y circuit 33 has a structure which is a combination of the sustain pulse circuit 14 and the reset/address voltage generation circuit in FIG. 6, and generates signals other than the scan pulse to be applied to the odd-numbered Y electrode group. Similarly, the even-numbered Y circuit 34 generates signals other than the scan pulse to be applied to the even-numbered Y electrode group. On the other hand, the X electrode drive circuit 41 comprises an auxiliary scan driver 42, an odd-numbered X circuit 43 and an even-numbered X circuit 44, wherein the odd-numbered X circuit 43 generates signals other than the auxiliary scan pulse to be applied to the odd-numbered X electrode group and the even-numbered X circuit 44 generates signals other than the auxiliary scan pulse to be applied to the even-numbered X electrode group. The control circuit 19 controls each part. The PDP apparatus in the fifth embodiment has the same structure as that of the conventional ALIS method PDP apparatus except in that the auxiliary scan driver 42 is provided.

Figure 15:
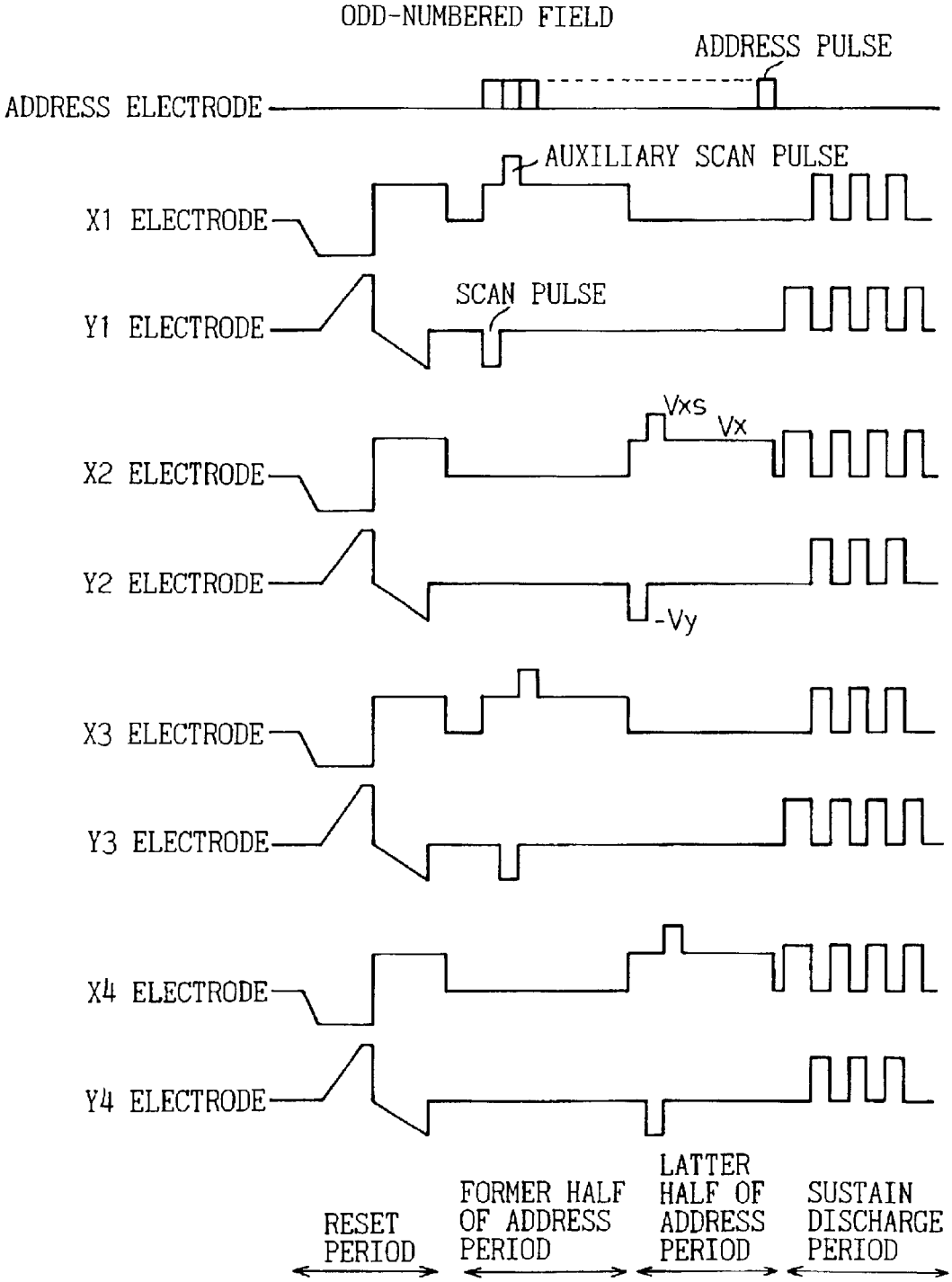
FIG. 15 is a diagram that shows the drive waveforms (odd-numbered field) of the PDP apparatus in the fifth embodiment.
Figure 16:
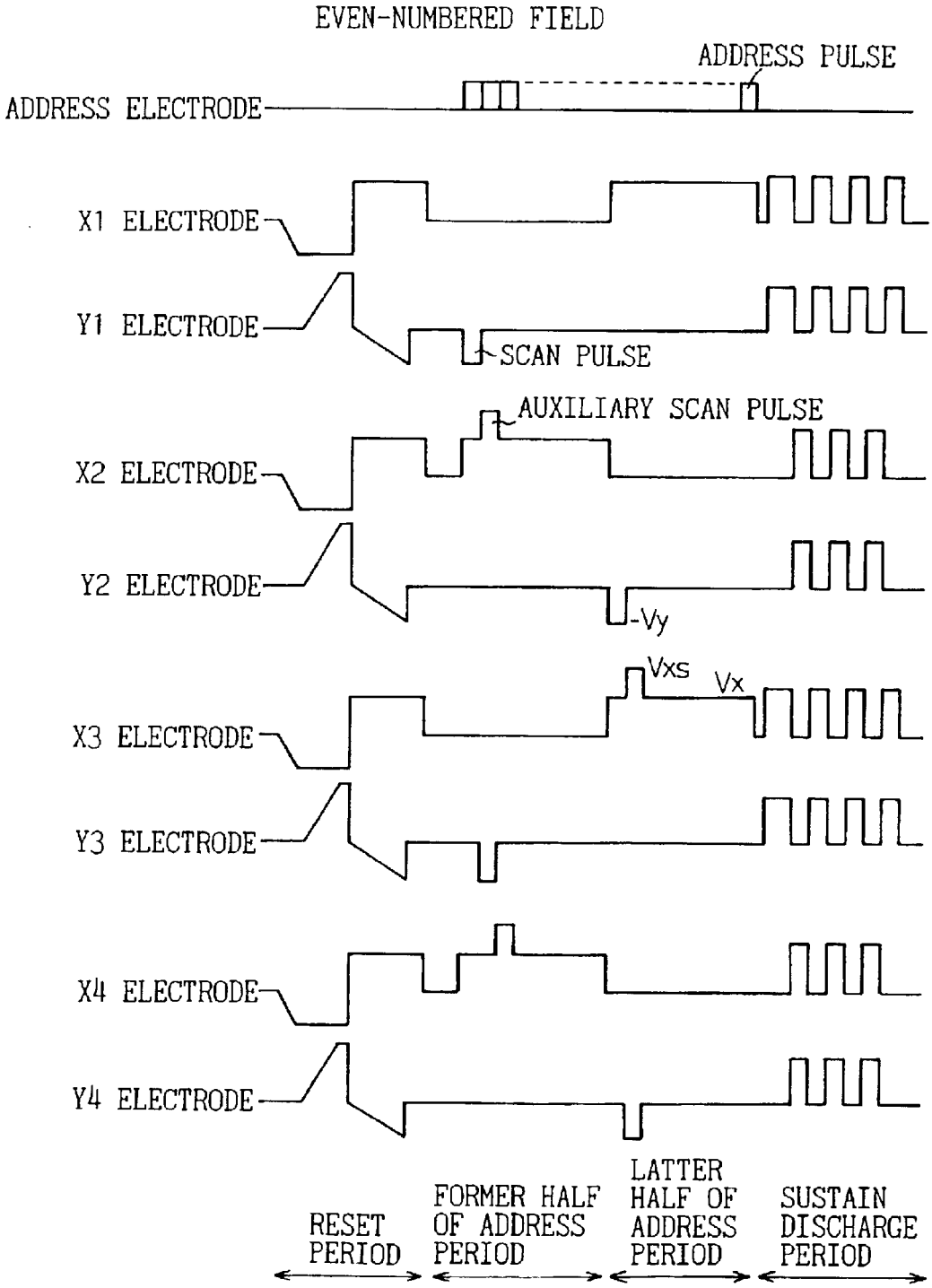
FIG. 16 is a diagram that shows the drive waveforms (even-numbered field) of the PDP apparatus in the fifth embodiment.

FIG. 15 and FIG. 16 show the drive waveforms of the PDP apparatus in the fifth embodiment, wherein FIG. 15 shows the waveforms in the odd-numbered field and FIG. 16 shows the waveforms in the even-numbered field. As is obvious, from comparison with FIG. 12, the drive waveforms in the reset period and the address period in the odd-numbered field in the fifth embodiment are the same as those in the fourth embodiment, but in the sustain discharge period, they differ in that the phases of the sustain pulses to be applied to the even-numbered Y electrode and the even-numbered X electrode are opposite. In other words, in the first half of the address period in the odd-numbered field, in a state in which Vx is being applied to the odd-numbered X electrode and 0V is being applied to the even-numbered X electrode, the scan pulse is applied sequentially to the odd-numbered Y electrode, the address pulse is applied in synchronization with it, and the address discharge is caused to occur in the fifth embodiment. In synchronization with the removal of the scan pulse, the auxiliary scan pulse is applied sequentially to the odd-numbered X electrode. In the second half of the address period, in a state in which 0V is being applied to the odd-numbered x electrode and Vx is being applied to the even-numbered X electrode, the scan pulse is applied sequentially to the even-numbered Y electrode, the address pulse is applied in synchronization with it, and the address discharge is caused to occur. In synchronization with the removal of the scan pulse, the auxiliary scan pulse is applied sequentially to the even-numbered X electrode. In the sustain discharge period, the sustain pulses of the same phase are applied to the odd-numbered Y electrode and the even-numbered X electrode, and the sustain pulses of the same phase are applied to the even-numbered Y electrode and the odd-numbered X electrode. In this way, the odd-numbered display lines L1, L3, . . . are displayed and discharge is prevented from being induced in the even-numbered display lines L2, L4, . . . .

In the first half of the address period in the even-numbered field in the fifth embodiment, in a state in which 0V is being applied to the odd-numbered X electrode and Vx is being applied to the even-numbered x electrode, the scan pulse is applied sequentially to the odd-numbered Y electrode, the address pulse is applied in synchronization with it, and the address discharge is caused to occur. In synchronization with the removal of the scan pulse, the auxiliary scan pulse is applied sequentially to the even-numbered x electrode. In the second half of the address period, in a state in which 0V is being applied to the odd-numbered X electrode and Vx is being applied to the even-numbered x electrode, the scan pulse is applied sequentially to the even-numbered Y electrode, the address pulse is applied in synchronization with it, and the address discharge is caused to occur. In synchronization with the removal of the scan pulse, the auxiliary scan pulse is applied sequentially to the odd-numbered X electrode. In the sustain discharge period, the sustain pulses of the same phase are applied to the odd-numbered X electrode and the odd-numbered Y electrode, and the sustain pulses of the same phase are applied to the even-numbered X electrode and the even-numbered Y electrode.

The drive waveforms in the fifth embodiment differ from one example of those in the conventional ALIS method in that the auxiliary scan pulse is added. It is also possible to add the auxiliary scan pulse of the present invention to the waveforms other than those in the conventional ALIS method.

Although the embodiments of the present invention are described above, the present invention is not limited to these embodiments and it is possible to apply the present invention to various PDP driving methods.

Effects of the Invention

As described above, according to the present invention, as the address time required for one display line can be shortened without causing an erroneous write to occur, it is possible to shorten the address period, achieve a higher luminance by expanding the sustain discharge period using the saved time, and improve the display quality by increasing the number of subfields to increase the number of gradations.

I claim:

1. A driving method of a plasma display panel comprising plural first and second electrodes that extend in a first, common direction, adjacent to each other, and plural third electrodes that extend in a second direction, perpendicular to the common direction, the method comprising:

applying a scan pulse sequentially to the plural second electrodes in an address period during which an address discharge, to select a cell to be lit, is caused to occur;

after the scan pulse is removed, applying an auxiliary scan pulse to the first electrode that makes up a pair of electrodes with a second electrode to which the scan pulse has been applied, to form a display line;

adjusting a number of times of sustain discharges in a display field, wherein:

when the number of times of sustain discharges in a display field is decreased, increasing the width of the scan pulse and not applying an auxiliary scan pulse, and when the number of times of sustain discharges in a display field is increased, decreasing the width of the scan pulse and applying an auxiliary scan pulse.

2. A driving method of a plasma display panel, as set forth in claim 1, wherein the first and second electrodes are divided into an odd-numbered electrode group and an even-numbered electrode group and the address period has a first half of the address period during which the scan pulse and the auxiliary scan pulse are applied sequentially to one of the electrode groups to cause the address discharge to occur, and a second half of the address period during which the scan pulse and the auxiliary scan pulse are applied sequentially to the other of the electrode groups to cause address discharge to occur subsequently.

3. A driving method of a plasma display panel, as set forth in claim 2, wherein an auxiliary scan base voltage is applied to the first electrodes of the one of the electrode group so that the voltage between the first electrodes and the second electrodes of the one of the electrode groups becomes large, and the auxiliary scan pulse is applied so as to overlap the auxiliary scan base voltage in the first half of the address period, and the auxiliary scan base voltage is applied to the first electrodes of the other of the electrode groups so that the voltage between the first electrodes and the second electrodes of the other of the electrode groups becomes large, and the auxiliary scan pulse is applied so as to overlap the auxiliary scan base voltage in the second half of the address period.

4. A driving method of a plasma display panel, as set forth in claim 1, wherein the width of the auxiliary scan pulse is greater than that of the scan pulse.

5. A driving method of a plasma display panel, as set forth in claim 1, wherein the voltage between the first electrode and the second electrode when the auxiliary scan pulse is applied is equal to or less than that between the first electrode and the second electrode when the scan pulse is applied.

6. A driving method of a plasma display panel, as set forth in claim 1, wherein the voltage between the first electrode and the second electrode when the auxiliary scan pulse is applied is almost equal to that between the first electrode and the second electrode when a sustain discharge is caused to occur.

7. A driving method of a plasma display panel, as set forth in claim 1, wherein the voltage between the first electrode and the second electrode when the auxiliary scan pulse is applied is equal to or less than a final voltage, when a discharge is caused to occur to erase or adjust wall charges in the final process in a reset period.

8. A driving method of a plasma display panel comprising plural first and second electrodes that extend in a first, common direction, adjacent to each other, and plural third electrodes that extend in a second direction, perpendicular to the common direction, the method comprising:

applying a scan pulse sequentially to the plural second electrodes in an address period during which an address discharge, to select a cell to be lit, is caused to occur;

after the scan pulse is removed, applying an auxiliary scan pulse to the first electrode that makes up a pair of electrodes with a second electrode to which the scan pulse has been applied, to form a display line; and a display field is composed of plural subfields having respective, different numbers of times of sustain discharges, including:

subfields to which the auxiliary scan pulse is applied according to the number at times of sustain discharges, and subfields to which the auxiliary scan pulse is not applied.

9. A driving method of a plasma display panel, as set forth in claim 8, wherein the first and second electrodes are divided into an odd-numbered electrode group and an even-numbered electrode group and the address period has a first half of the address period during which the scan pulse and the auxiliary scan pulse are applied sequentially to one of the electrode groups to cause the address discharge to occur, and a second half of the address period during which the scan pulse and the auxiliary scan pulse are applied sequentially to the other of the electrode groups to cause the address discharge to occur subsequentially.

10. A driving method of a plasma display panel, as set forth in claim 9, wherein in a state in which an auxiliary scan base voltage is being applied to one of electrode groups of the first electrode that makes up a pair of electrodes with one that belongs to either one of the second electrode groups to form the display line so that the voltage between the two electrode groups becomes large, the auxiliary scan pulse is applied so as to overlap the auxiliary scan base voltage in the first half of the address period, and in a state in which the auxiliary scan base voltage is being applied to one of the other electrode group of the first electrode that makes up a pair of electrodes with one that belongs to the other second electrode group to form the display line so that the voltage therebetween becomes large, the auxiliary scan pulse is applied so as to overlap the auxiliary scan base voltage in the second half of address period.

11. A driving method of a plasma display panel, as set forth in claim 8, wherein the width of the auxiliary scan pulse is greater than that of the scan pulse.

12. A driving method of a plasma display panel, as set forth in claim 8, wherein the voltage between the first electrode and the second electrode when the auxiliary scan pulse is applied is equal to or less than that between the first electrode and the second electrode when the scan pulse is applied.

13. A driving method of a plasma display panel, as set forth in claim 8, wherein the voltage between the first electrode and the second electrode when the auxiliary scan pulse is applied is almost equal to that between the first electrode and the second electrode when a sustain discharge is caused to occur.

14. A driving method of a plasma display panel, as set forth in claim 8, wherein the voltage between the first electrode and the second electrode when the auxiliary scan pulse is applied is equal to or less than a final voltage, when a discharge is caused to occur to erase or adjust wall charges in the final process in a reset period.

15. A plasma display apparatus, comprising:

plasma display panel having plural first and second electrodes extending in a first, common direction, adjacent to each other, and plural third electrodes that extend in a second direction perpendicular to the common direction, a display line being formed by adjacent first and second electrodes;

a third drive circuit that applies a voltage selectively to the third electrodes;

a second drive circuit that applies a scan pulse selectively to the second electrodes; and a first drive circuit that applies an auxiliary scan pulse selectively to the first electrodes each first electrodes making up a pair of electrodes with the adjacent second electrode to which the scan pulse is applied, after the application of the scan pulse to each of the second electrodes is completed, wherein:

a display field is composed of plural subfields having respective, different numbers of times of sustain discharges, including:

subfields to which the auxiliary scan pulse is applied according to the number of times of sustain discharges, and subfields to which an auxiliary scan pulse is not applied.

16. A driving method of a plasma display panel, as set forth in claim 15, wherein a display field is composed of an odd-field and as even-field, in the odd-field, odd-numbered first electrodes and odd-numbered second electrodes are divided in a first electrode group and even-numbered first electrodes and even-numbered second electrodes are divided into a second electrode group and the address period has a first half of the address period during which the scan pulse and the auxiliary scan pulse are applied sequential to one of the first and second electrode groups to cause the address discharge to occur, and a second half of the address period during which the scan pulse and the auxiliary scan pulse are applied sequentially to the other of the first and second electrode groups to cause the address discharge to occur subsequently, and in the even-field, the even-numbered first electrode and odd-numbered second electrodes are divided into a first electrode group end odd-numbered first electrodes and even-numbered second electrodes are divided into a second electrode group and the address period has a first half of the address period during which the scan pulse and the auxiliary scan pulse are applied sequentially to one of the first and second electrode groups to cause the address discharge to occur, and a second half of the address period during which the scan pulse and the auxiliary scan pulse are applied sequentially to the other of the first and second electrode groups to cause the address discharge to occur subsequently.

17. A driving method of a plasma display panel, as set forth in claim 16, wherein in both of the odd-field and the even-field, an auxiliary scan base voltage is applied to the first electrodes of the one of the electrode groups so that the voltage between the first electrodes and the second electrodes of the one of the electrode groups becomes large and the auxiliary scan pulse is applied so as to overlap the auxiliary scan base voltage in the first half of the address period, and the auxiliary scan base voltage is applied to the first electrodes of the other of the electrode groups so that the voltage between the first electrodes and the second electrodes of the other of the electrode groups becomes large, the auxiliary scan pulse is applied so as to overlap the auxiliary scan base voltage in the second half of the address period.

18. A driving method of a plasma display panel comprising plural first and second electrodes that extend in a first, common direction and are arranged adjacent to each other and plural third electrodes that extend in a second direction, perpendicular to the first, common direction, wherein a scan pulse is applied sequentially to the plural and electrodes in an address period during which an address discharge to select a cell to be lit is caused to occur and after the scan pulse is removed, an auxiliary scan pulse is applied to the first electrode that makes up a pair of electrodes with the second electrode to which the scan pulse has been applied to form a display line, wherein the first and second electrodes are divided into an odd-numbered electrode group and an even-numbered electrode group and the address period has a first half of the address period during which the scan pulse and the auxiliary scan pulse are applied sequentially to one of the electrode groups to cause the address discharge to occur, and a second half of the address period during which the scan pulse and the auxiliary scan pulse are applied sequentially to the other of the electrode groups to cause the address discharge to occur subsequently.

19. A driving method of a plasma display panel, as set forth in claim 18, wherein an auxiliary scan base voltage is applied to the first electrodes of the one of the electrode groups so that the voltage between the first electrodes and the second electrodes of the one of the electrode groups becomes large and the auxiliary scan pulse is applied so as to overlap the auxiliary scan base voltage in the first half of the address period, and the auxiliary scan base voltage is applied to the first electrodes of the other of the electrode groups so that the voltage between the first electrodes and the second electrodes of the other of the electrode groups becomes large, the auxiliary scan pulse is applied so as to overlap the auxiliary scan base voltage in the second half of the address period.

20. A driving method of a plasma display panel, comprising plural first and second electrodes that extend in the same direction and are arranged adjacent to each other and plural third electrodes that extend in the direction perpendicular to that of a plural first and second electrodes, wherein a scan pulse is applied sequentially to the plural second electrodes in an address period during which an address discharge to select a cell to be lit is caused to occur and after the scan pulse is removed, an auxiliary scan pulse is applied the first electrode that makes up a pair of electrodes with the second electrode to which the scan pulse has been applied to form a display line, wherein a display field is composed of odd-field and even-field, in the odd-field, odd-numbered first electrodes and odd-numbered second electrodes are divided into a first electrode group and even-numbered first electrodes and even-numbered second electrodes are divided into a second electrode group and the address period has a first half of the address period during which the scan pulse and the auxiliary scan pulse are applied sequentially to one of the first and second electrode groups to cause the address discharge to occur, and a second half of the address period during which the scan pulse and the auxiliary scan pulse are applied sequentially to the other of the first and second electrode groups to cause the address discharge to occur subsequently, and in the even-field, the even-numbered first electrodes and odd-numbered second electrodes are divided into a first electrode group and odd-numbered first electrodes and even-numbered second electrodes are divided into a second electrode group and the address period has a first half of the address period during which the scan pulse and the auxiliary scan pulse are applied sequentially to one of the first and second electrode groups to cause the address discharge to occur, and a second half of the address period during which the scan pulse and the auxiliary scan pulse are applied sequentially to the other of the first and second electrode groups to cause the address discharge to occur subsequently.

21. A driving method of a plasma display panel, as set forth in claim 20, wherein in both of the odd-field and the even-field, an auxiliary scan base voltage is applied to the first electrodes of the one of the electrode groups so that the voltage between the first electrodes and the second electrodes of the one of the electrode groups becomes large and the auxiliary scan pulse is applied so as to overlap the auxiliary scan base voltage in the first half of the address period, and the auxiliary scan base voltage is applied to the first electrodes of the other of the electrode groups so that the voltage between the first electrodes and the second electrodes of the other of the electrode groups becomes large, the auxiliary scan pulse is applied so as to overlap the auxiliary scan base voltage in the second half of the address period.

22. A plasma display apparatus comprising:

a plasma display panel having plural first and second electrodes extending in a first common direction, adjacent to each other, and plural third electrodes that extend in a second direction perpendicular to the common direction, a display line being formed by adjacent first and second electrodes;

a third drive circuit that applies a voltage selectively to the third electrodes;

a second drive circuit that applies a scan pulse selectively to the second electrodes; and a first drive circuit that applies an auxiliary scan pulse selectively to the first electrodes, each first electrode making up a pair of electrodes with the adjacent second electrode to which the scan pulse is applied, after the application of the scan pulse to each of the second electrodes is completed, wherein:

the number of times of sustain discharges in a display field is adjusted so that when the number of times of sustain discharges in a display field is decreased, the width of the scan pulse is increased and no auxiliary scan pulse is applied, and when the number of times of sustain discharges in a display field is increased, the width of the scan pulse is decreased and the auxiliary scan pulse is applied.

* * * * *

UNITED STATES PATENT AND TRADEMARK OFFICE

CERTIFICATE OF CORRECTION

PATENT NO. : 6,963,320 B2
APPLICATION NO. : 10/315070
DATED : November 8, 2005
INVENTOR(S) : Yoshikazu Kanazawa It is certified that error appears in the above-identified patent and that said Letters Patent is hereby corrected as shown below:

Column 11,
Line 63, after “cause” insert -- the --.

Column 12,
Line 2, after “large” delete “,”.
Line 49, delete “at” and insert -- of --.
Line 63, delete “subsequentially” and insert -- subsequently --.

Column 13,
Line 12, after “of” insert -- the --.
Line 63, delete “in” and insert -- into --.
Line 67, delete “sequential” and insert -- sequentially --.

Column 14,
Line 7, delete “electrode” and insert -- electrodes --.
Line 8, delete “end” and insert -- and --.
Line 38, delete “and” and insert -- second --.

Column 15,
Line 5, after “of” delete “a” and insert -- the --.
Line 9, after “applied” delete “to”.

Signed and Sealed this

Eleventh Day of July, 2006

JON W. DUDAS
*Director of the United States Patent and Trademark Office*